US006307727B1

(12) United States Patent
DeAngelis et al.

(10) Patent No.: US 6,307,727 B1
(45) Date of Patent: Oct. 23, 2001

(54) ESD FOOTWEAR GROUNDING SYSTEM

(75) Inventors: Mario E. DeAngelis, Flemington; Jack P. Honore, III, Robbinsville, both of NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/434,425

(22) Filed: Nov. 4, 1999

(51) Int. Cl.[7] ..... H05F 3/00
(52) U.S. Cl. ..... 361/220; 361/223; 361/224
(58) Field of Search ..... 361/223, 224, 361/220, 212

(56) References Cited

U.S. PATENT DOCUMENTS 4,812,948 * 3/1989 Bird et al. ..... 361/223
5,576,924 * 11/1996 Hee ..... 361/223
5,786,977 * 7/1998 Cohen ..... 361/223

* cited by examiner

*Primary Examiner*—Stephen W. Jackson
(74) *Attorney, Agent, or Firm*—Woodbridge & Associates, P.C.; Richard C. Woodbridge

(57) ABSTRACT

This invention relates to a footwear grounding device to reduce static charge buildup on personnel handling electronic components and products that are sensitive to electrostatic discharge (ESD) events. The device incorporates a conductive strap having reusable adhesive elements near one end which permit proper positioning of the strap in the user's shoe and prevent the strap from shifting out of said position during the course of the day.

5 Claims, 1 Drawing Sheet

ESD FOOTWEAR GROUNDING SYSTEM

BACKGROUND OF THE INVENTION

1. Field of the Invention

This invention relates to a footwear grounding device to reduce static charge buildup on personnel handling electronic components and products that are sensitive to electrostatic discharge (ESD) events.

2. Description of Related Art

The potential harmful effects to electrical components resulting from ESD discharges are well known. One well known method to combat this problem is to reduce static charge buildup on personnel handling ESD-sensitive electronic components and products by having these individuals wear foot grounders to form a conductive path between the wearer's feet and a conductive floor system. FIG. 1 depicts such a typical prior art foot grounder which utilizes a conductive grounding tab that is inserted between the wearer's foot covering and his shoe. However, current designs of the conductive grounding tab permit movement of the tab during use. Sufficient movement of the conductive grounding tab during walking can occur, resulting in total loss of electrical continuity with the wearer's foot and subsequent loss of groundability of the wearer.

SUMMARY OF THE INVENTION

The present invention prevents movement of the conductive grounding tab thus preserving electrical continuity and ESD protection properties for the wearer.

These and other features of the invention will be more fully understood by reference to the following drawings.

DETAILED DESCRIPTION OF THE INVENTION

During the course of this description, like numbers will be used to identify like elements according to different figures which illustrate the invention.

Figure 1:
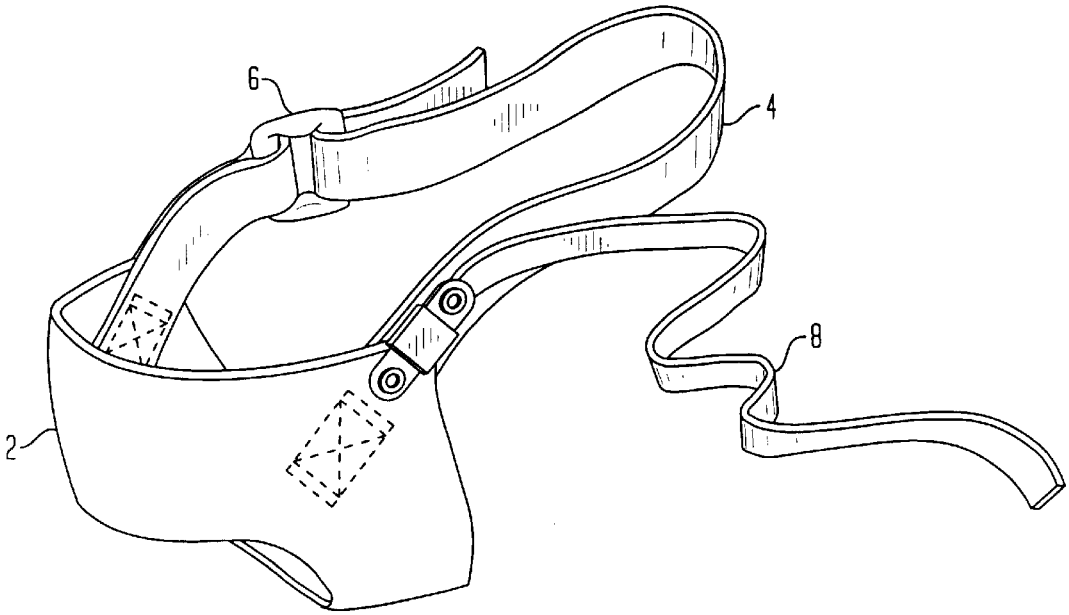
FIG. 1 (PRIOR ART)
FIG. 1 is a perspective view of a conventional foot grounding device having a conductive grounding tab.

FIG. 1 shows a well known existing heel grounding foot device which employs a conductive rubber "cup" 2 which fits onto the heel of a shoe and is held on the wearer's foot by a strap 4 and buckle 6 arrangement. The cup is connected to a conductive grounding tab 8 which tucks into the wearer's shoe. Important in the proper use of this device is that this tab maintain proper contact with the wearer's foot thereby providing electrical continuity.

In the preferred embodiment of the present invention, the grounding tab is modified to allow for the adherence of the conductive grounding tab to the wearer's sock/foot covering. This is accomplished by incorporating reusable adhesive elements 10 such as the hooked portion of the Velcro hook/loop system. The Velcro hooks will adhere the conductive grounding tab to the wearer's sock/foot covering whereby the sock/foot covering material acts as the loops in the Velcro hook/loop system.

This important feature of the present invention both prevents the conductive grounding tab from shifting during use, and also simplifies the correct application of the ESD foot-grounder system. Currently, proper application of the ESD foot grounder system requires that the wearer remove their shoes and place the conductive grounding tab lengthwise along the full axial length of the inside of the shoe. Frequently, when the shoe is then replaced on the wearer's foot, the grounding tab moves from its proper position. Consequently, even this initial placement of the grounding tab can be a somewhat difficult and time-consuming procedure —requiring several attempts to accomplish correctly. It is likely that not all individuals would be sufficiently conscientious in the initial placement of this grounding tab and its repositioning should it shift out of position during the day (assuming that they are even aware that such a shifting had occurred). Accordingly, the effectiveness of this ESD grounding system is compromised.

In the preferred embodiment of the present invention the wearer would simply extend the conductive grounding tab lengthwise on the floor with the Velcro hook adhesive-side facing up. The wearer would then only need to position the center of their foot over the conductive grounding tab thereby aligning the end of the tab with the toe and of their sock/foot covering, and step down on the conductive grounding tab adhering it to the sock/foot covering. The wearer would then insert their foot into the shoe to accomplish correct positioning of the conductive grounding tab thus ensuring proper ESD groundability. Remaining application of the ESD foot grounder system would proceed as per manufacturer's recommendation for applying the conductive rubber heel cup of the ESD foot grounding system to the wearer's shoe.

Alternative embodiments of the present invention would permit alternative types of reusable adhesive elements. The quantity or number of Velcro hooks (or any alternative adhesive system) could be adjusted to suit wearability and comfort of the wearer. The adhesive element that is used could be placed along the entire length of the section of the conductive grounding tab that would be placed in the wearer's shoes or alternatively, could be located in one or more sections. For example, the adhesive element could be place only at the tab's end, in the vicinity of the wearer's toes.

Figure 2:
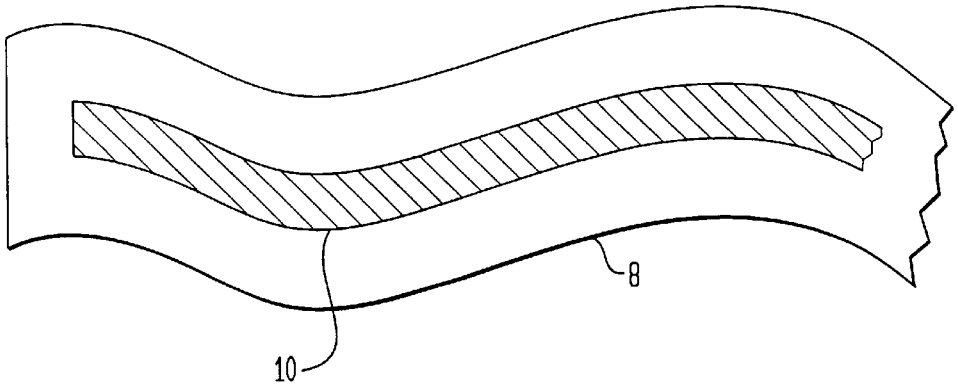
FIG. 2 is a perspective view of the conductive grounding tab having the adherence feature of the present invention.

Further, as depicted in FIG. 2, the adhesive system may consist of a narrow strip located approximately in the center of the conductive grounding tab. Alternatively, the adhesive element could span an increasing percentage of the entire width of the grounding tab.

In those alternative embodiments in which the adhesive element more fully covers the portion of the grounding tab in contact with the wearer's foot, use of a conductive adhesive material, or a conductive coating to that material, would be utilized to maintain the proper electrical continuity between the grounding tab and the wearer's foot.

While the invention has been described with reference to the preferred embodiment thereof, it will be appreciated by those of ordinary skill in the art that various modifications can be made to the structure and function of the individual parts of the system without departing from the spirit and scope of the invention as a whole.

We claim:

1. An electrostatic discharge control device attachable to a user's shoe for dissipating static electricity from the body of a person having a foot enclosed by a foot covering comprising:

a. a conductive section worn on the outside of the shoe and essentially in contact with the ground, and b. a relatively thin, flat conductive tab having opposite sides and a first end attached to the conductive section and a second end which is placed inside the user's shoe, said second end of said conductive tab having attached to one of said sides a reusable adhesive element made of a hooked portion of a Velcro® hook/loop system wherein said hooked portion is engaged with said foot covering when said second end and said foot is located inside the users shoe.

2. The electrostatic discharge control device of claim 1 wherein said one or more reusable adhesive elements are positioned along essentially the entire length of the portion of the conductive tab which is located inside the user's shoe.

3. The electrostatic discharge control device of claim 1 wherein said one or more reusable adhesive elements are positioned along one or more sections of the portion of the conductive tab which is located inside the user's shoe.

4. The electrostatic discharge control device of claim 3 wherein said hook portion is in proximity to the end of the user's foot that contains the user's toes.

5. The electrostatic discharge control device of claim 1 wherein said reusable adhesive element is treated with a coating to thereby provide electrical conductivity between the user's foot and said conductive section.

* * * * *